US005408241A

United States Patent [19]

Shattuck, Jr. et al.

[11] Patent Number: 5,408,241

[45] Date of Patent: Apr. 18, 1995

[54] APPARATUS AND METHOD FOR TUNING EMBEDDED ANTENNA

[75] Inventors: Murray G. Shattuck, Jr., Westminster; Frank B. Bilek, Arvada; Thomas A. Metzler, Boulder, all of Colo.

[73] Assignee: Ball Corporation, Muncie, Ind.

[21] Appl. No.: 110,105

[22] Filed: Aug. 20, 1993

[51] Int. Cl.[6] ..... H01Q 1/38

[52] U.S. Cl. ..... 343/700 MS; 343/846; 29/600

[58] Field of Search ..... 343/700 MS, 846, 830, 343/848, 705, 829; H01Q 1/38; 29/600

[56] References Cited

U.S. PATENT DOCUMENTS

| | | | |
|---|---|---|---|
| 4,012,741 | 3/1977 | Johnson | 343/700 MS |
| 4,089,003 | 5/1978 | Conroy | 343/700 MS |
| 4,131,894 | 12/1978 | Schiavone | 343/700 MS |
| 4,316,194 | 2/1982 | De Santis et al. | 343/700 MS |
| 4,660,048 | 4/1987 | Doyle | 343/700 MS |
| 4,800,392 | 1/1989 | Garay et al. | 343/700 MS |
| 4,827,271 | 5/1989 | Berneking et al. | 343/700 MS |
| 4,835,540 | 5/1989 | Haruyama et al. | 343/700 MS |
| 4,864,314 | 9/1989 | Bond | 343/700 MS |
| 4,924,236 | 5/1990 | Schuss et al. | 343/700 MS |
| 4,929,959 | 5/1990 | Sorbello et al. | 343/700 MS |
| 5,036,336 | 7/1991 | Bouko et al. | 343/853 |
| 5,153,600 | 10/1992 | Metzler et al. | 343/700 MS |
| 5,241,321 | 8/1993 | Tsao | 343/700 MS |
| 5,245,745 | 9/1993 | Jensen et al. | 343/700 MS |

FOREIGN PATENT DOCUMENTS 2147744 10/1983 United Kingdom ..... H01Q 1/38

OTHER PUBLICATIONS

"Tuning Stubs for Microstrip Patch Antennas" by M. du Plessis and J. H. Cloete, IEEE, no month 1993, pp. 964–967.

*Primary Examiner*—Donald Hajec
*Assistant Examiner*—Hoanganh Le
*Attorney, Agent, or Firm*—Gilbert E. Alberding

[57] ABSTRACT

An apparatus and method for tuning a multi-radiating element embedded microstrip antenna is disclosed. In one embodiment, the lower resonant frequency of an antenna is tuned using trimmable tabs integral with an upper radiating element and/or scrapable recessed edges on the ground plane surrounding the upper element and/or trimmable tabs interconnected with the ground means and extending inwardly towards the upper element.

21 Claims, 4 Drawing Sheets

APPARATUS AND METHOD FOR TUNING EMBEDDED ANTENNA

FIELD OF THE INVENTION

This invention relates generally to an apparatus and method for tuning a stacked microstrip antenna and, more particularly, to a stacked antenna having a lower frequency that can be selectively tuned after assembly.

BACKGROUND OF THE INVENTION

One type of multi-radiating element microstrip antenna is a dual-resonant, stacked antenna. Such antennas can be embedded and are particularly apt for mobile Global Positioning System (GPS) applications.

As shown in FIG. 1, elements of a typical dual-resonant embedded antenna 10 are seated in a depression defined by an electrically conductive and grounded housing 14. A first layer of dielectric material 18 is disposed in the bottom of the depression. A first, lower frequency radiating element 22 is disposed on top of the first layer of dielectric material 18. A second layer of dielectric material 26 is positioned on top of the first radiating element 22, and a second, higher frequency radiating element 30 is disposed thereon. The specifications of the depression defined by the housing 14 and the thicknesses of the stacked components can be selected such that the second radiating element 30 is substantially conformal with the top surface of the housing 14. A ground plane 34 is interconnected with and extends inward from housing 14 to surround the second radiating element 30 and define an aperture 36 therebetween. The ground plane 34 can also be conformal with the top surface of the housing 14. One or more probe feed means 16 can be provided to feed the elements 22 and 30 in series to yield the desired polarization (e.g., a single feed on the diagonal of stacked $\lambda/2$ elements to yield circular polarization).

In the past, to decrease the lower resonant frequency, the resonant dimension of the lower radiating element 22 has been adjusted during production (i.e. prior to final assembly). Similarly, the upper frequency has been tuned by adjusting the resonant dimension of the upper radiating element 30. In order to effectively decrease the lower frequency during manufacture, the effect of air pockets created while bonding elements together during subsequent assembly, variations in the attributes of the dielectric materials, and additional variables have to be taken into account. Often, manufacturers have been unable to predict the effect of these factors with a sufficient degree of accuracy. Thus, the lower resonant frequency is often inaccurate upon assembly, and the antenna cannot be used. This results in a lower production yield, thereby increasing the overall cost of the operable antennas.

SUMMARY OF THE INVENTION

It is therefore an object of the present invention to provide a method and apparatus to tune a lower resonant frequency of a multi-resonant embedded antenna in later stages of manufacture so that the predicted effects of fewer factors need be considered. A related object of the present invention is to provide a method and apparatus for tuning a lower resonant frequency of a multi-resonant embedded antenna after assembly of the antenna.

A further object of the present invention is to provide externally accessible means for increasing both a lower and an upper resonant frequency of a multi-resonant embedded antenna and/or for selectively increasing the lower resonant frequency and/or for selectively decreasing the lower resonant frequency.

The present invention includes a ground means that defines a depression in which other elements of the antenna are seated. A lower radiating element (e.g., a $\lambda/2$ element) is disposed in the depression and is operable to transmit and receive at a first frequency. An upper radiating element (e.g., a $\lambda/2$ element) is disposed above the lower radiating element and is operable to transmit and receive at a second frequency higher than the first frequency. The upper radiating element and an upper surface of the ground means define an aperture therebetween and are preferably conformal. A tuning means is provided which is disposed at least partially in a different plane than the lower radiating element and is operable to tune at least the first operating frequency.

In one embodiment, the tuning means comprises one or more trimmable tabs which are integral with and extend outwardly from the upper radiating element, and which can be trimmed to selectively increase the lower and upper resonant frequencies of the antenna. Such tabs may extend into opposing recesses in the surrounding ground means and are preferably centered about an axis upon which a feed point to the upper radiating element is located.

The tuning means may alternatively or additionally comprise one or more recessed internal edges on the ground means which may be scraped away to selectively decrease the lower resonant frequency. Such recessed edges are preferably defined as the internal edges of tabs which are positioned within recesses in and which project inwardly from the ground means, and which are centered about an axis on which a feed point to the upper radiating element is located. Preferably, the recessed edges are defined in the upper surface of the ground means in opposed and receiving relation to the trimmable tuning tabs extending from the upper radiating element. In many applications (e.g., dual fed $\lambda/2$ elements), it may be desirable to provide at least one trimmable tuning tab extending from each side of the upper radiating element and a scrapable recessed edge in opposed, receiving relation to each. As an alternative to scrapable recessed edges (or recessed tabs), the lower resonant frequency can also be adjusted upward and downward by the provision of tuning means comprising a conductive member (e.g., a fine-threaded screw) which passes through the bottom of the grounded depression, preferably under the lower radiating element, and which may be selectively positioned in variable spaced relation to the lower radiating element.

In an extended embodiment, a pair of trimmable tabs, interconnected with the ground means, extend inwardly towards the upper radiating element, with a scrapable recessed edge (or recessed tab) of the ground means and/or a trimmable tab extending outwardly from the upper radiating element positioned therebetween. The pair of inwardly extending tabs preferably project into opposing recesses in the upper radiating element and may be employed to selectively increase the lower resonant frequency. Further, such tabs are preferably integral with the upper surface of the ground means.

It has been discovered that, by removing portions of the trimmable tabs extending outward from the upper radiating element, the resonant frequencies of both the lower and upper radiating element can be increased.

Additionally, it has been discovered that, by scraping away portions of the recessed edges (or recessed tabs) described hereinabove, the resonant frequency of the lower radiating element can be selectively decreased. Additionally, it has been discovered that by removing portions of the described pairs of trimmable tabs extending inwardly towards and spaced from the upper radiating element, the lower operating frequency can be selectively increased. Since each of the described tuning means are exposed, the upper and lower resonant frequencies of the antenna can be adjusted during final steps of or after final assembly of the antenna. Further, errors in the prediction of variations due to material and assembly variations can be more readily compensated for and production yields can approach 100%.

Other objects and advantages of the present invention will be apparent from the following description with reference to accompanying figures.

DETAILED DESCRIPTION

Figure 1:
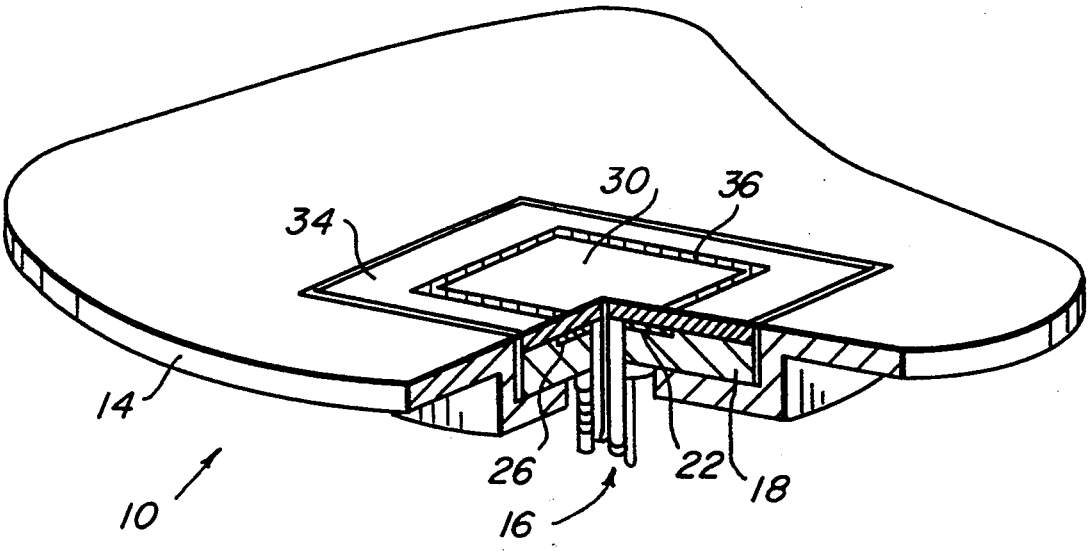
Fig.-1 (PRIOR ART)
FIG. 1 illustrates a prior art dual-resonant embedded antenna.
Figure 2A:
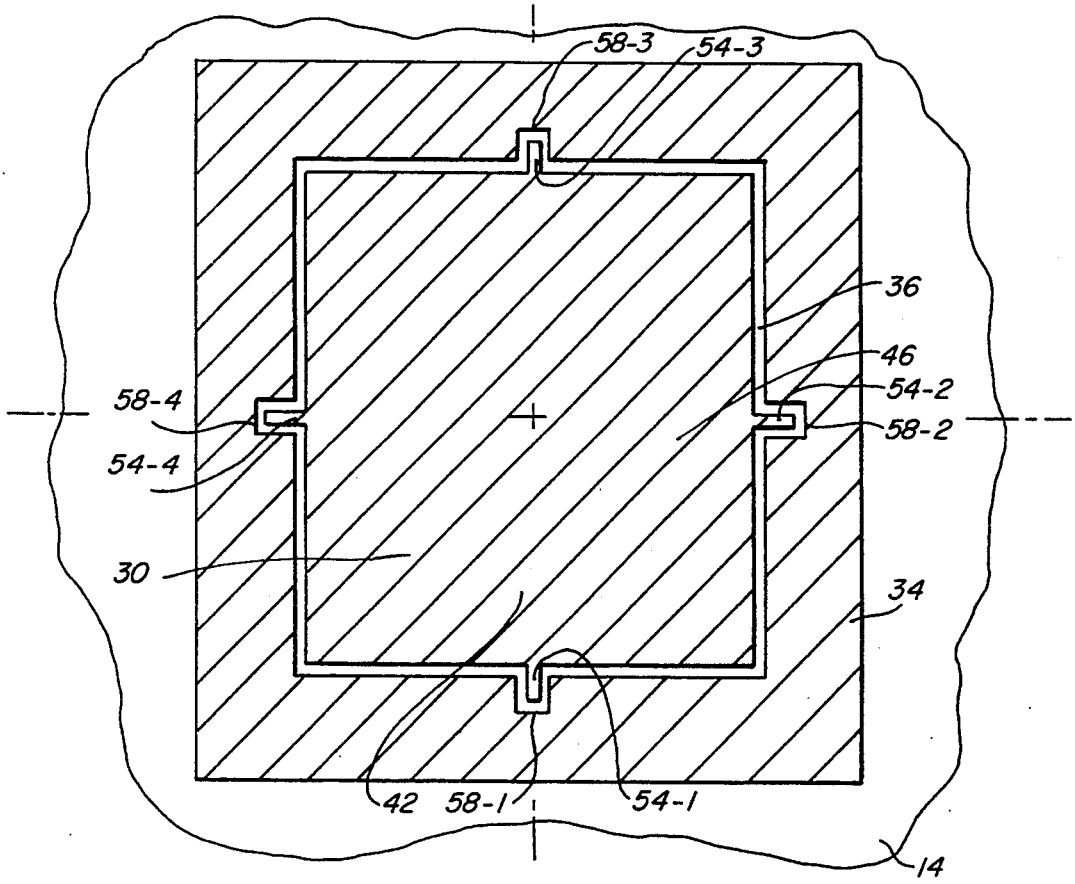
FIGS. 2*a* and 2*b* illustrate top and cross-sectional views of one embodiment of the present invention.
Figure 2B:
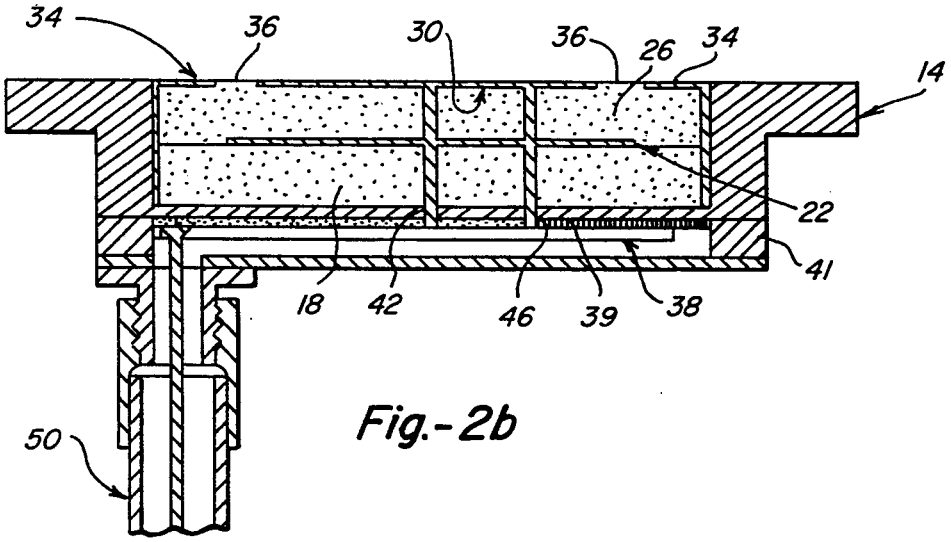

FIGS. 2*a* and 2*b* illustrate a dual-resonant embedded antenna in accordance with one embodiment of the present invention. An electrically conductive and grounded upper housing 14 defines a depression in which other parts of the antenna are seated. The antenna comprises two stacked, one-half wavelength microstrip radiating elements 22 and 30. Each radiating element 22 and 30 is disposed on a separate layer of dielectric material, 18 and 26 respectively, and the elements are stacked such that the upper radiating element 30 is substantially conformal with the top surface of upper housing 14. A frame-like ground plane 34 is also positioned on dielectric layer 26 and surrounds upper radiating element 30, defining an aperture 36 therebetween. The exposed surface of ground plane 34 also conforms to the outer surface of upper housing 14 and is interconnected thereto. As shown, ground plane 34 is interconnected to upper housing 14 and may include sidewalls which extend into the depression.

Lower radiating element 22 operates at a first resonant frequency. The upper radiating element 30 operates at a second frequency which is higher than the first resonant frequency. The slot aperture 36 between the upper radiating element 30 and ground plane 34 transmits/receives signals at these two frequencies when the antenna is in a transmit/receive mode of operation, respectively.

A ninety-degree hybrid feed network 38 is provided within an electrically conductive lower housing 41, positioned below the depression of upper housing 14, and in the transmit mode, excites two orthogonal coaxial probes 42 and 46 which directly and capacitively feed the upper and lower radiating elements 30 and 22, respectively. Hybrid feed network 38 is fed by coaxial cable 50. Orthogonal probes 42 and 46 are positioned to feed both radiating elements 30, 22 at 50 ohm impedance matching points and in orthogonal modes (i.e., for vertical and horizontal polarization) so as to effect circular polarization (e.g. for GPS applications).

Orthogonal coaxial probes 42 and 46 are both unshielded as they pass through the dielectric layer 18, lower radiating element 22, upper dielectric layer 26, and upper radiating element 30, and are soldered directly to upper radiating element 30. The lower radiating element 22 thus includes two apertures for receiving probes 42 and 46 and for capacitive coupling therebetween.

As shown in FIG. 2*a*, ground plane 34 is provided with a recessed edge 58 on each of the four interior edges of ground plane 34, and upper radiating element 30 is provided with a correspondingly opposed tab 54 on each of the four sides of the upper radiating element 30. Preferably, tabs 54 and recessed edges 58 are centered about an axis upon which a feed point to upper radiating element 30 is located. For example, in FIG. 2*a* tabs 54 and recessed edges 58 are preferably disposed in opposing, centered relation about an axis upon which one of either probe 42 or 46 is connected to upper radiating element 30.

Trimming of at least one but preferably all of the tabs 54 increases the lower resonating frequency as well as the upper resonant frequency of the antenna. Additionally, scraping away material on one but preferably all of the recessed edges 58 decreases the lower resonant frequency of the antenna. Since tab 54 and edge 58 are disposed on an exposed outer surface of the antenna, they are easily accessible after final assembly. Therefore, tab 54 and edge 58 provide tuning means for increasing the lower resonating frequency and decreasing the lower resonant frequency, respectively, without having to adjust the resonant dimension of the lower radiating element 22. By way of example, for GPS applications, the antenna can be readily tuned to operate at 1.227 GHz and 1.575 GHz for the lower and upper resonant frequencies.

Figure 3A:
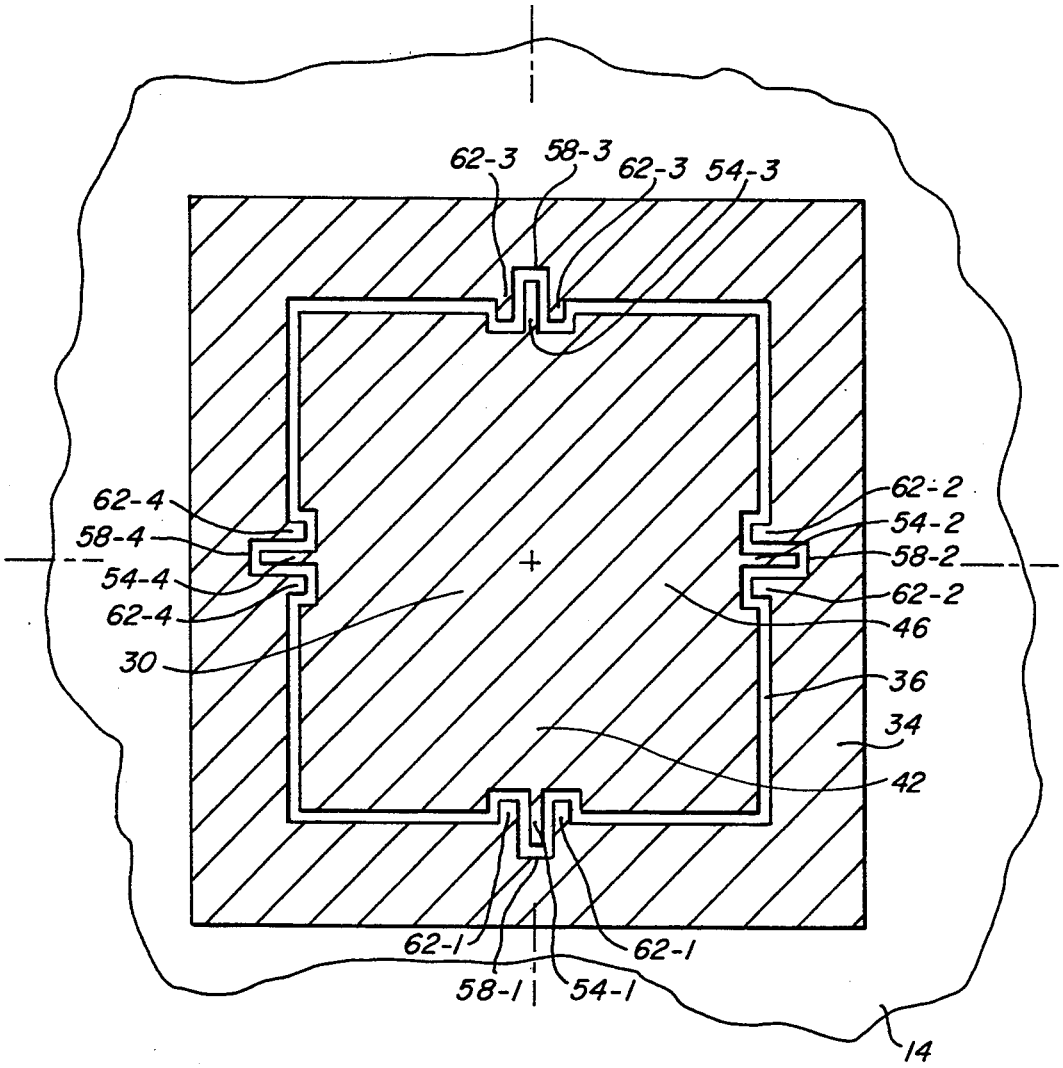
FIGS. 3*a* and 3*b* illustrate top views of extended embodiments of the present invention.
Figure 3B:
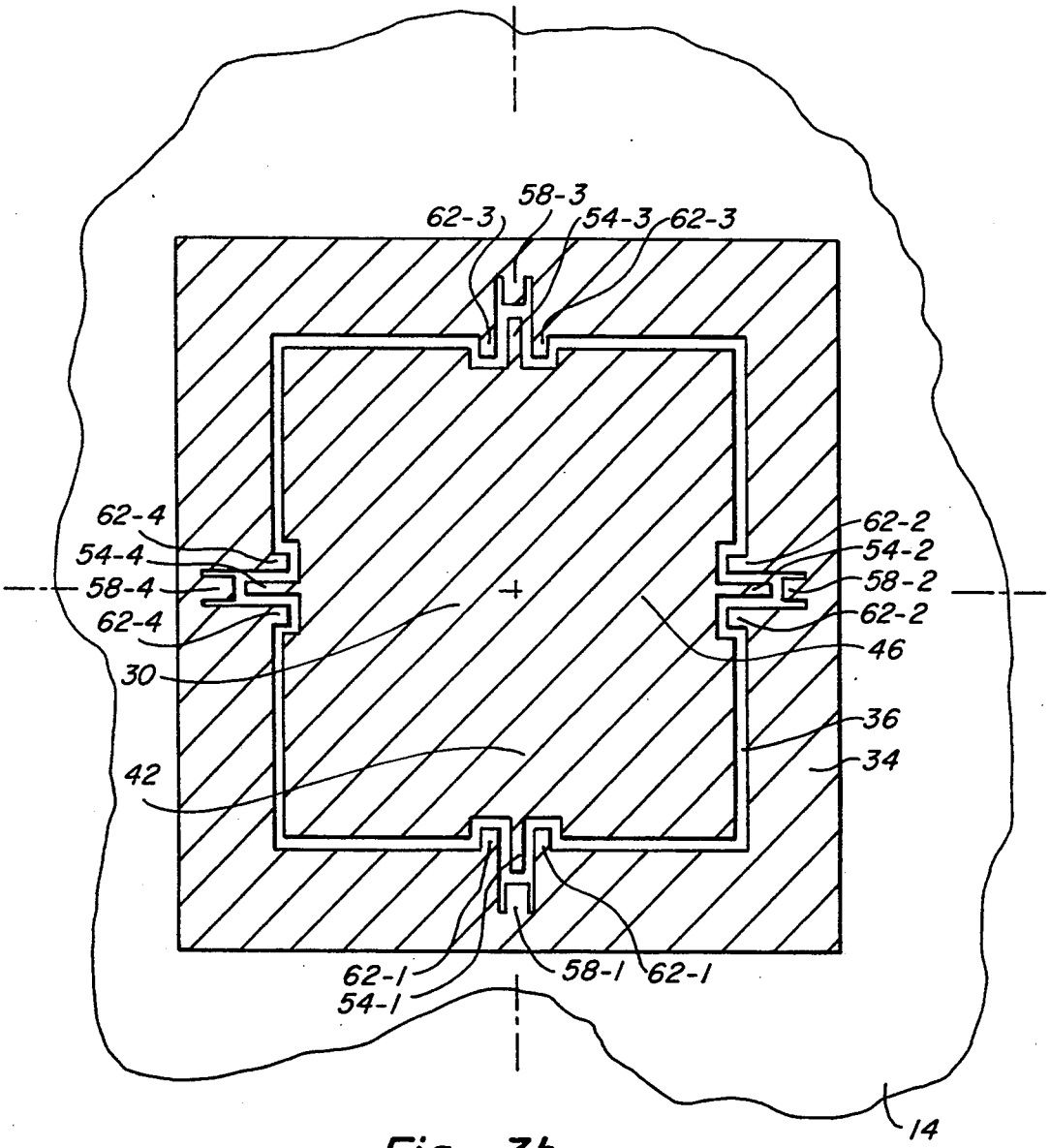

FIGS. 3*a* and 3*b* illustrate top views of extended embodiments of the present invention. In these embodiments, upper radiating element 30 is provided with tabs 54, and ground plane 34 is provided with recessed edges 58 or recessed tabs 58. In addition, pairs of tabs 62 are provided on each of the four interior edges of the ground plane 34. Preferably tabs 62 project into opposing recesses defined in the upper radiating element 30. In these embodiments, trimming of tabs 54 and scraping of material on recessed edges or tabs 58 have the aforementioned effects on the upper and lower resonating frequencies. Also, the trimming of one, but preferably all of tabs 62 selectively increases the lower resonant frequency. Tabs 62 thereby provide an additional means for critically tuning the antenna after final assembly.

The construction of a properly tuned dual-resonant embedded antenna according to one embodiment of the present invention will now be explained.

Initially, each of the two radiating elements 22 and 30 are bonded or etched onto its respective dielectric layer 18 and 26. The lower radiating element 22 is then peripherally trimmed to specifications which have been estimated, taking into account material and assembly variations. This trimming of the lower radiating element 22 roughly tunes the lower resonant frequency for the antenna. Dielectric layer 26, which carries the upper radiating element 30, is then bonded to the surface of lower radiating element 22. The entire assembly, both radiating elements 22 and 30 and their dielectric layers 18 and 26, is then positioned within the depression formed by housing 14. The depth of the depression and the thicknesses of the dielectric layers and radiating elements are selected so that the upper radiating element is substantially conformal with the outer surface of housing 14.

Ground plane 34 is subsequently provided to surround radiating element 30 and define slot aperture 36 therebetween. Ground plane 34 is conformal with and interconnected to the top surface of housing 14. As noted, the slot aperture 36 permits electromagnetic radiation at the two discrete frequencies to be transmitted or received by the antenna.

Holes are then drilled at the 50 ohm impedance points through radiating elements 30 and 22 and dielectric layers 26 and 18 in order to receive coaxial orthogonal probes 42 and 46. Both probes 42 and 46 are connected to upper radiating element 30 (e.g., by soldering).

sion only affects the lower resonant frequency on the order of a few MHz for an antenna designed to operate at GPS frequencies. Thus tab 62 can be used to "fine tune" the lower resonant frequency.

It is desirable for most applications to maintain symmetry in the radiation pattern of the antenna 10. Therefore, any trimming of tab 54-1 is balanced by substantially equal trimming of tab 54-3. Similarly, tabs 54-2 and 54-4, 62-1 and 62-3, and 62-2 and 62-4 and recessed edges or tabs 58-1 and 58-3, 58-2 and 58-4 are all substantially equally trimmed or scraped to maintain the symmetry of the antenna's radiation pattern.

A summary of the approximate effects on the upper and lower resonant frequencies is given in the chart below.

| Trimmed Tabs/ | Lower Resonant Frequency | | Upper Resonant Frequency | |
|---|---|---|---|---|
| Scraped Edges | At Probe 42 | At Probe 46 | At Probe 42 | At Probe 46 |
| 54-1, 54-3 | ↑ by approx. 1.3% | | ↑ by approx. 4% | |
| 54-2, 54-4 | | ↑ by approx. 1.3% | | ↑ by approx. 4% |
| 58-1, 58-3 | | ↓ by approx. 3–4% | | |
| 58-2, 58-4 | ↓ by approx. 3–4% | | | |
| 62-1, 62-3 | | ↑ by <10 MHz | | |
| 62-2, 62-4 | ↑ by <10 MHz | | | |

For tuning purposes, the upper and lower resonant frequencies of the antenna are then measured on the coaxial orthogonal probes 42 and 46. If either the upper or the lower resonant frequency is not within the specified tolerances, tabs and/or edges are trimmed and/or scraped to compensate as described hereinafter.

In the first embodiment of the present invention depicted in FIGS. 2*a*, tab 54 and recessed edge 58 are provided on the upper radiating element 30 and ground plane 34, respectively. It has been found that scraping ground plane material from edge 58-1 will decrease the lower resonant frequency as measured at probe 46. Similarly, scraping material at edge 58-2 will decrease the lower resonant frequency as measured at probe 42. It is typically desirable that the lower resonant frequency measured at each of probe 42 and probe 46 be substantially equal. Likewise, it is typically desirable that the upper resonant frequency measured at each probe also be substantially equal.

Further, it has been found that trimming tab 54-1 increases the upper resonant frequency as measured at probe 42. However, trimming tab 54-1 also increases the lower resonant frequency as observed at probe 42. Similarly, trimming tab 54-2 increases both the upper and lower resonant frequencies as measured at probe 46. The observed change in frequency in the lower resonant frequency caused by trimming tab 54 is about one-third of the change observed in the upper resonant frequency. If tab 54 is on the order of 0.025 inches wide and 0.075 inches long, the upper resonant frequency can be tuned over approximately 4 percent bandwidth.

The embodiments of the present invention illustrated in FIGS. 3*a* and 3*b* include additional tabs 62 extending inwardly from ground plane 34, and in the embodiment of FIG. 3*b*, the recessed edges 58 are defined by inwardly extending tabs. In order to maintain symmetry in the radiation pattern of the antenna, two tabs 62 are provided, one on each side of tab 54. Trimming of tabs 62-1 (both 62-1 tabs are preferably trimmed substantially equally) will increase the lower resonant frequency at probe 46. Similarly, trimming of tabs 62-2 will increase the lower resonant frequency measured at probe 42. Trimming of tabs 62 of the illustrated dimen- Consider the case in which, after final assembly of the antenna, the lower resonant frequency at probe 42 is too low and at probe 46 is too high. Also, the upper resonant frequency at both probe 42 and 46 is too high. First, tabs 54-1, 54-2, 54-3 and 54-4 are trimmed until the upper resonant frequency at both probes is measured to be a desired value. Next, since the trimming of tab 54 affects the lower resonant frequency as well, the lower resonant frequency is again measured at each probe. Assume now that the lower resonant frequency at probe 42 is just slightly lower than desired, and that the lower resonant frequency at probe 46 is considerably too high. In order to bring the lower resonant frequency at probe 42 to the desired value, tabs 62-2 and 62-4 are trimmed to raise the lower resonant frequency just slightly. In addition, recessed edges or tabs 58-1 and 58-3 are scraped to decrease the lower resonant frequency at probe 46 to the desired level. Both frequencies are thus tuned without having to access the lower radiating element.

Once the antenna has been critically tuned to operate at desired upper and lower resonant frequencies, the ninety-degree hybrid feed network 38 is connected to probes 42 and 46. Hybrid feed network 38 is preferably disposed on a circuit board 39 which is enclosed in and attached to lower housing 41 which is interconnected to upper housing 14. Both probes 42 and 46 extend through both the bottom wall of upper housing 14 to connect to hybrid feed network 38, which in turn is operatively connected to coaxial shielded cable 50. The shield of cable 50 provides an electrical ground to housings 41 and 14 to which it is interconnected. The portions of both probes 42 and 46 which pass through the bottom wall of grounded upper housing 14 are shielded.

As described above, the tabs and recessed edges of the different embodiments of the present invention, provide a way to critically tune the antenna after final assembly. The present invention therefore provides a means and method for tuning both the upper and lower resonant frequency even though the lower radiating element is inaccessible once it has been bonded into place.

Those skilled in the art will appreciate that there may be many modifications and variations of the above-described embodiments which may be made without departing from the novel and advantageous teachings of this invention. For example, variations in the sizes of the trimmable tabs and/or recessed edges will change the range of frequencies over which the embedded antenna may be tuned. Also, the shape and positioning of tabs provided on the upper radiating element and ground plane could be altered without departing from the scope of the present invention as claimed. Additionally, it is believed that the present invention can be used with embedded microstrip antennas that employ more than the illustrated two radiating elements.

What is claimed is:

1. An embedded microstrip antenna, operable at both a first frequency and a second frequency which is higher than said first frequency, comprising:

a ground means defining a depression;

a lower radiating element, disposed in said depression and lying in a first plane, for use in transmitting or receiving at said first frequency;

an upper radiating element, disposed above said lower radiating element, for use in transmitting or receiving at said second frequency; and tuning means, disposed at least partially outside said first plane of said lower radiating element, for tuning said antenna by varying at least said first frequency.

2. The embedded microstrip antenna as recited in claim 1, wherein said tuning means is accessible after final assembly of said antenna.

3. The embedded microstrip antenna as recited in claim 1, further comprising feed means, coupled to said upper radiating element at least one feed point, wherein at least a portion of said tuning means is centered about an axis on which said at least one feed point is located.

4. The embedded microstrip antenna as recited in claim 1, wherein said tuning means is operatively connected to said upper radiating element.

5. The embedded microstrip antenna as recited in claim 1, wherein said tuning means includes at least one trimmable tab that is integral with and extends outward from said upper radiating element.

6. The embedded microstrip antenna as recited in claim 1, wherein said tuning means comprises at least one scrapable recessed edge on said ground means.

7. The embedded microstrip antenna as recited in claim 1, wherein said tuning means includes a trimmable tab integral with and extending outward from said upper radiating element and an opposing scrapable recessed edge on an upper surface of said ground means.

8. The embedded microstrip antenna as recited in claim 1 wherein said tuning means includes a trimmable tab that is integral to said upper radiating element and extending in a first direction, a scrapable recessed edge on said ground means that is located in opposed receiving relation to said trimmable tab, and a pair of trimmable tabs inter-connected to said ground means that are symmetrically disposed about said trimmable tab and extend in a second direction that is substantially opposite to said first direction.

9. The embedded microstrip antenna as recited in claim 1, wherein said ground means includes an upper surface and said upper radiating element is conformal with said upper surface.

10. The embedded microstrip antenna as recited in claim 9, wherein said tuning means includes means, integral with said upper surface, for increasing said first operating frequency.

11. The embedded microstrip antenna as recited in claim 9, wherein said tuning means includes means, integral with said upper surface, for decreasing said first operating frequency.

12. The embedded microstrip antenna as recited in claim 9, wherein said tuning means comprises means integral with said upper radiating element and means integral with said upper surface, for varying said first operating frequency.

13. The embedded microstrip antenna as recited in claim 1 further comprising a ninety-degree hybrid feed network coupled to both of said upper and lower radiating elements such that said antenna is capable of being used to transmit or receive circularly polarized radiation.

14. A method for tuning an embedded microstrip antenna, comprising the steps of:

assembling an embedded microstrip antenna having a ground means defining a depression, a lower radiating element capable of being used at a first frequency and disposed in said depression and above a first dielectric space, and an upper radiating element capable of being used at a second frequency that is different than said first frequency and disposed above a second dielectric space which is disposed above said first radiating element;

tuning, after said assembling step, at least said first frequency of the embedded microstrip antenna using a tuning means external to said assembled antenna.

15. The method for tuning an embedded microstrip antenna as recited in claim 14, wherein said assembling step includes the following steps:

disposing said upper and lower radiating elements on upper and lower dielectric layers, respectively;

bonding said lower radiating element and said lower dielectric layer to said upper dielectric layer such that said upper and lower radiating elements are separated by said upper dielectric layer;

placing said upper and lower radiating elements and said upper and lower dielectric layers in the depression formed by said ground means.

16. The method for tuning an embedded microstrip antenna as recited in claim 14, wherein said lower radiating element lies in a plane and said step of assembling includes disposing said tuning means at least partially outside said plane of said lower radiating element.

17. The method for tuning an embedded microstrip antenna as recited in claim 14, wherein said tuning step includes the step of trimming at least one tab that is integral with said upper radiating element to adjust said first frequency.

18. The method for tuning an embedded microstrip antenna as recited in claim 14, wherein said tuning step includes the step of trimming at least one tab that is integral with said ground means to increase said first frequency.

19. The method for tuning an embedded microstrip antenna as recited in claim 14, wherein said assembling step includes the step of coupling a ninety-degree hybrid feed network to both of said upper and lower radiating elements such that said antenna is capable of being used to transmit or receive circularly polarized radiation.

20. The method for tuning an embedded microstrip antenna as recited in claim 14, wherein said tuning step includes the step of scraping away a portion of said ground means to decrease said first frequency.

21. The method for tuning an embedded microstrip antenna as recited in claim 14, wherein said tuning step includes the step of scraping away a portion of said ground means on a recessed edge of said ground means to decrease said first frequency.

* * * * *